United States Patent [19]

McConnell

[11] Patent Number: 4,901,964

[45] Date of Patent: Feb. 20, 1990

[54] RAIL CLAMP

[76] Inventor: Bernard E. McConnell, Rte. 2, Box 87, Greenville, Tex. 75401

[21] Appl. No.: 693,145

[22] Filed: Jan. 22, 1985

[51] Int. Cl.[4] ..... B25B 5/04

[52] U.S. Cl. ..... 248/231.5; 24/514; 269/239

[58] Field of Search ..... 248/214, 225.31, 228, 248/231.3, 231.5, 231.6, 231.7, 316.5, 316.6, 643, 72; 24/514, 513, 569; 269/237, 239, 238

[56] References Cited

U.S. PATENT DOCUMENTS

| | | | |
|---|---|---|---|
| 814,228 | 3/1906 | McGahan | 269/239 |
| 884,772 | 4/1908 | Sorensen | 248/225.31 |
| 2,347,081 | 4/1944 | Caton | 24/514 |
| 2,482,708 | 9/1949 | Gordinier | 269/238 |
| 2,744,552 | 5/1956 | Novick | 269/238 |
| 3,469,810 | 9/1969 | Dorris | 248/214 |
| 3,533,590 | 10/1970 | Swire | 248/231.5 |

FOREIGN PATENT DOCUMENTS

| | | | |
|---|---|---|---|
| 1477088 | 4/1967 | France | 269/239 |
| 81397 | 3/1953 | Norway | 248/231.5 |
| 607069 | 8/1948 | United Kingdom | 269/238 |

*Primary Examiner*—Ramon O. Ramirez
*Assistant Examiner*—Robert A. Olson
*Attorney, Agent, or Firm*—Dennis T. Griggs

[57] ABSTRACT

A clamp for attaching surgical support apparatus onto the side rail of an operating table includes a clamp body having an attachment portion adapted for coupling engagement with surgical support apparatus, a fixed jaw member for engaging the upper corner portions of the side rail, a movable compression member for engaging the lower corner portions of the side rail, and driving means for moving the compression member to an open, retracted position allowing positioning of the jaw member and compression member about the opposite sides of the rail, and to an extended position in which the compression member is urged against a lower edge portion of the side rail with the rail being confined and compresssed between the fixed jaw and compression member. According to this arrangement, a compressive force is transmitted by the turn screw through the compression member against the side rail which firmly anchors the clamp at any desired position along the rail. The clamp is removed from the rail simply by releasing the turn screw to allow the compression member to return to its retracted position, whereupon the clamp assembly may be completely removed from the side rail without disturbing the established positions of other surgical support devices also attached to the rail.

2 Claims, 2 Drawing Sheets

FIG. 3
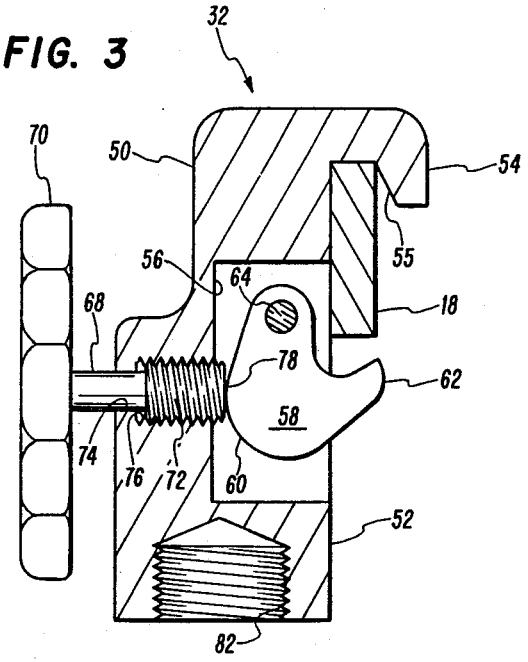
FIG. 4
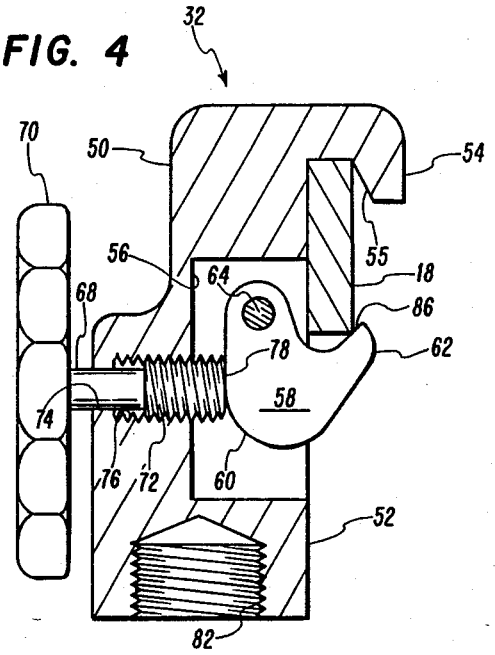
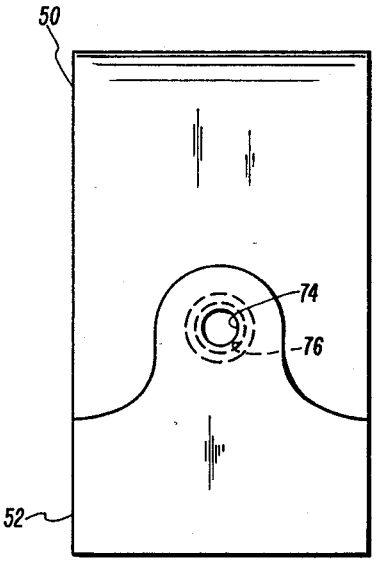
FIG. 5
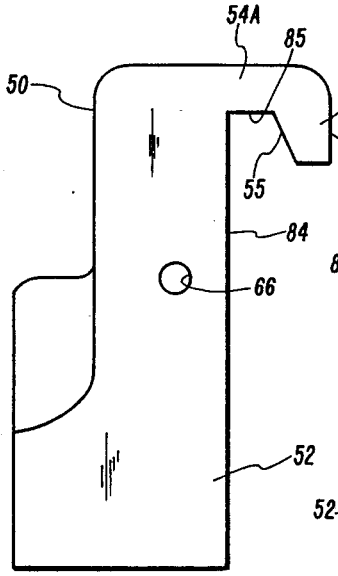
FIG. 6
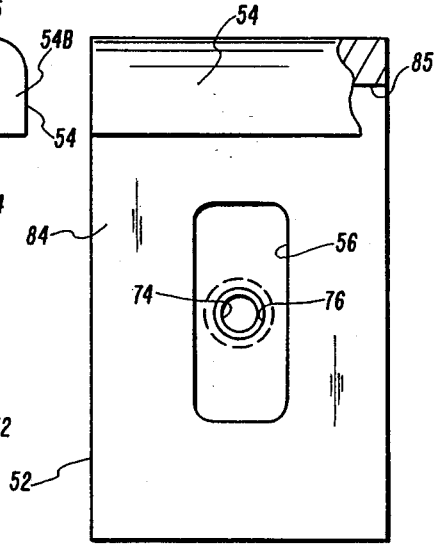
FIG. 7
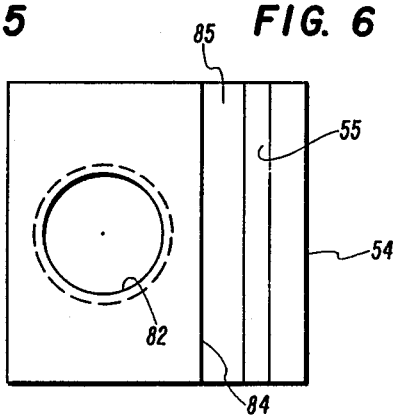
FIG. 8
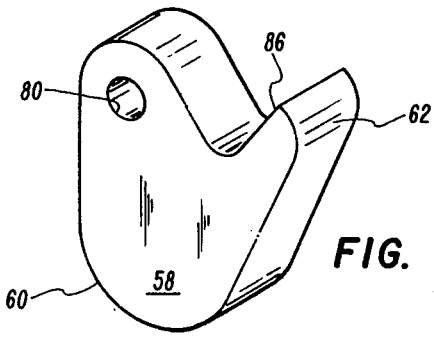
FIG. 9

RAIL CLAMP

FIELD OF THE INVENTION

This invention relates generally to the art of clamping devices, and in particular to a manually operated clamp for attaching surgical support apparatus to the side rail of an operating table.

1. Background of the Invention

In the performance of orthopedic surgery and related procedures, it is often necessary to support a portion of the patient's body including one or more limbs in a particular position during the procedure, and also to vary the position from time to time. In some cases, operating room personnel manually support the particular extremity and change the position of the extremity as desired. Additionally, pillows and other padded devices have been used. Such devices often obstruct the performance of surgery or the procedures and are not easily moved from one position to another. Moreover, the use of operating room personnel to support a patient during a surgical procedure is unsatisfactory in that the assistant supporting the extremity may tire and find it necessary to change position at some critical or otherwise inconvenient time.

Accordingly, various mechanical devices have been constructed and utilized for supporting and positioning various portions of a patient's body including the limbs during the performance of surgery on a portion of a limb itself or a connecting joint. Such mechanical devices are adapted for mounting onto an operating table or the like and generally include surgical suport apparatus overlying the sterile zone of the operating table. Such equipment is usually clamped onto the side rail of the operating table and may be moved about from time to time as required by the surgical procedure.

2. Description of the Prior Art

Conventional clamping devices utilized for anchoring surgical support equipment onto the side rail of an operating table have included a channel bracket and a turn screw which directly engages the side rail. The channel bracket is a C-shaped member which is inserted over the end of the side rail with flange portions overlapping the back side of the rail. According to this arrangement, the clamp is slidable to any unobstructed position along the rail but can only be mounted onto the rail or removed from the rail at its end portions. The channel bracket clamp is anchored in place by a turn screw which directly engages the face of the side rail.

When such conventional clamping devices are used during a surgical procedure, it is sometime necessary to relocate the surgical support apparatus to accomodate the various stages of the surgical procedure. In most instances, it is desirable to relocate a surgical support device without disturbing the established positions of other surgical support devices. However, because the conventional channel bracket clamp can only be removed at an end portion of the side rail, it is necessary to suspend the surgical procedure while intermediate clamps and support devices are temporarily removed from the side rail to allow a particular support device to be relocated, and while the intermediate clamps and support devices are re-positioned. Alternatively, an additional clamp and support device may be installed at a desired location, but only after existing clamps and support devices have been removed so that the new clamp and support device can be mounted on the rail and moved along its length to the desired position.

It will be appreciated that in surgical procedures, time is of the essence, and delays associated with relocation of support equipment are unwanted. Additionally, the presence of surgical support equipment about the sterile operating area limits the surgeon's access to the patient during the procedure. Thus it is generally desirable to limit the number of surgical support devices in and around the sterile zone, so that the operating surgeon and his attendants will have clear and unrestricted access to the patient.

SUMMARY OF THE INVENTION

The present invention provides an improved clamp for attaching surgical support apparatus onto the side rail of an operating table, and includes releasable coupling means which allow the clamp to be installed onto the side rail or removed from the side rail at any intermediate location along the side rail. Accordingly, the clamp of the present invention can be moved about from location to location without disturbing the established positions of other surgical support devices anchored to the same side rail.

In accordance with the preferred embodiment of the present invention, an improved clamp for attaching surgical support apparatus onto the side rail of an operating table includes a clamp body having an attachment portion adapted for coupling engagement with surgical support apparatus, a fixed jaw member for engaging the upper portion of the side rail, a movable compression member for engaging the lower portion of the side rail, and driving means for moving the compression member to an open, retracted position allowing positioning of the jaw member and compression member about opposite sides of the rail, and to an extended position in which the compression member is urged against a lower edge portion of the side rail with the rail being confined and compressed between the fixed jaw and compression member.

According to the foregoing arrangement, a compressive force is transmitted by the driving means through the compression member against the side rail which firmly anchors the clamp at any desired position along the rail. The clamp is removed from the rail simply by releasing the driving means to allow the compression member to be returned to its retracted position, whereupon the clamp assembly may be completely removed from the side rail without disturbing the established positions of other surgical support devices also attached to the rail.

According to the another aspect of the invention, the compression member is mounted for pivotal movement within a locking cavity and includes a jaw portion and a cam portion. The jaw portion is adapted to engage an edge portion of the side rail, and the cam portion of the compression member is adapted to engage a turn screw. The turn screw is movable through a threaded bore which communicates with the locking cavity. As the turn screw is advanced into the cavity, it engages the cam surface of the compression member and drives its jaw portion into compressive engagement with the lower corner of the side rail. When removal of the clamp is desired, the turn screw is withdrawn from the cavity through the threaded bore, thereby allowing the compression member to rotate to its retracted, open jaw position.

The superior features and advantages of the present invention will be further appreciated by those skilled in the art upon reading the detailed description which follows in conjunction with the attached drawings.

BRIEF DESCRIPTION OF THE DRAWINGS

FIG. 3 is a sectional view of a side rail clamp which illustrates the relative position of its various components during installation or removal from a side rail;

FIG. 4 is a view similar to FIG. 3 which illustrates the relative positions of the component parts of the clamping assembly when it is securely fastened onto the side rail;

FIG. 5 is a rear elevation view of the body portion of the clamping assembly shown in FIG. 3;

FIG. 6 is a side elevation view of the body portion for the clamping assembly shown in FIG. 3;

FIG. 7 is a front elevation view corresponding with the embodiment shown in FIG. 3;

FIG. 8 is a bottom plan view of the clamp body; and,

FIG. 9 is a perspective view of a rotary compression member.

DETAILED DESCRIPTION OF THE PREFERRED EMBODIMENT

Figure 1:
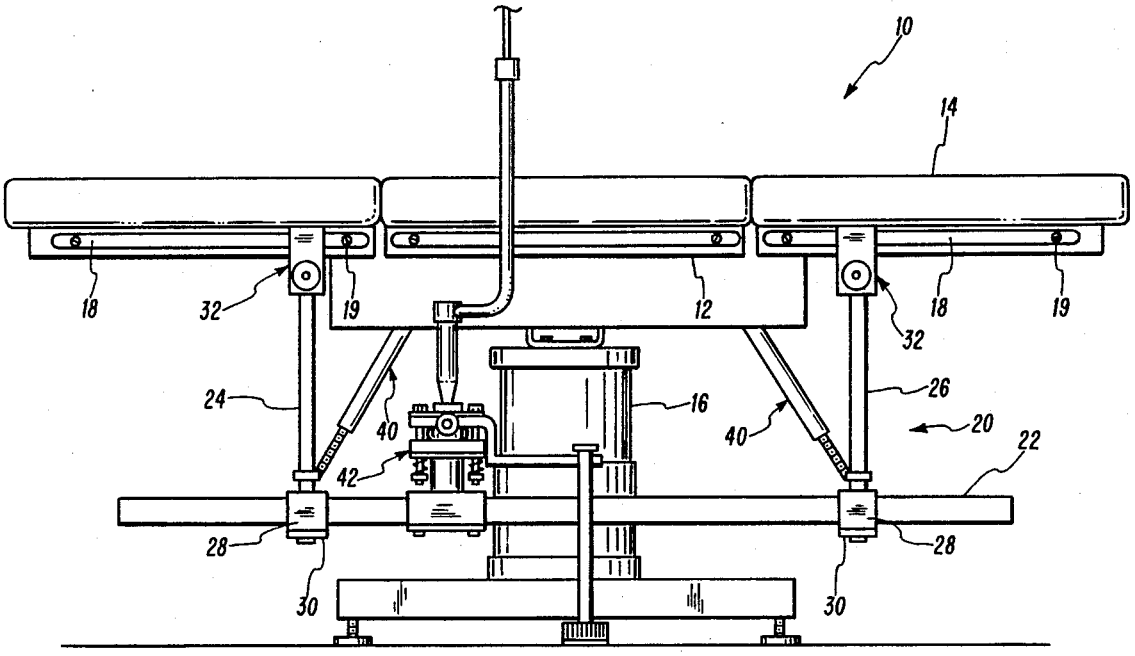
FIG. 1 is longitudinal side elevation view of an operating table having a side rail on which the clamp of the present invention is mounted.

In the description which follows, like parts are indicated throughout the specification and drawings with the same reference numerals, respectively. The drawings are not necessarily to scale and certain parts have been exaggerated to better illustrate details of the present invention.

The rail clamp of the present invention is particularly well-suited for use in connection with a conventional surgical operating table during the performance of surgery or other medical procedures.

Figure 2:
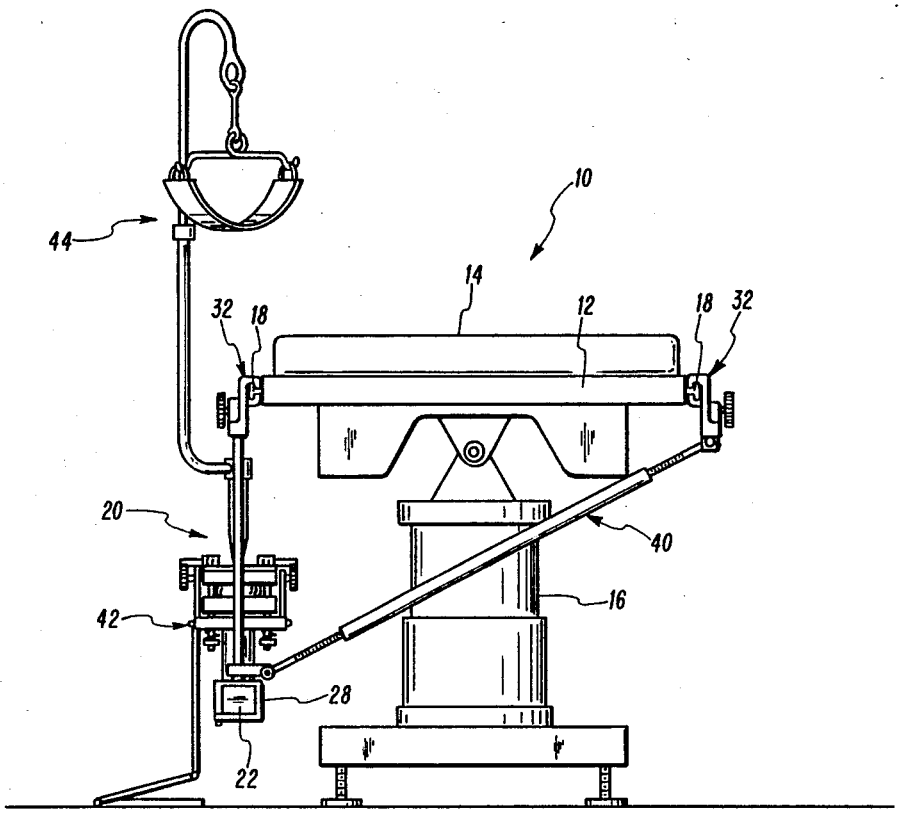
FIG. 2 is an end elevation view of the apparatus shown in FIG. 1.

Referring now to FIGS. 1 and 2 of the drawings, there is illustrated an operating table generally designated by the numeral 10 which includes a patient support table 12 and a sterile pad 14. The operating table 10 includes a base structure 16 which is capable of altering the position of the patient support table 12 to accomodate various surgical procedures. The table 10 also includes, along opposite longitudinal sides thereof, longitudinal support rails 18 which are rectangular in cross section and constructed of stainless steel. The side rails 18 appear as somewhat elongated flat metal bars which are mounted onto the table 12 and laterally spaced therefrom by pins 19.

Attached to the side rail 18 is an auxiliary support assembly 20 having as its principal component a horizontally disposed support bar 22. The support bar 22 is rectangular in cross section and may be solid or hollow, as desired. The support bar 22 is connected to a pair of spaced legs 24, 26, the lower ends of which are clamped onto the support bar 22 by a removable clamp assembly 28. The clamp assembly 28 is a rectangular frame having a plate 30 which compresses the bar 22 thereby securely anchoring each of the legs 24, 26 firmly in place.

According to the present invention, the support legs 24, 26 are fastened onto the side rails 18 by an improved rail clamp assembly 32. The clamp assembly 32 is configured to slide along the rails 18 and to be secured in a desired rail location in a manner to be described below. The support bar 22 is further stabilized by a pair of struts 40. Each strut 40 extends transversely from the lower support leg upwardly for connection to the opposite side rail 18 by a clamp assembly 32.

The support bar 22 when stabilized by the struts 40 and by the support legs 24, 26 serves as a stable platform onto which auxiliary support equipment such as the universal extremity positioner 42 is mounted.

In the performance of various surgical procedures, particularly in orthopedic surgery, it is necessary to support various portions of the body including its extremities, such as arms and legs, in a suspended position while the procedure is performed. For example, the sling assembly 44 as illustrated in FIG. 2 is attached to the universal extremity positioner 42 and is adapted to suspend an arm or a leg of a patient during a surgical procedure. During such a procedure, it may be necessary to move a portion of the extremity or to apply biasing forces in one direction or another. The support structure 20 makes this possible because of the stability provided by the improved clamp assembly 32.

Referring now to FIGS. 3 and 4, the improved clamp assembly 32 includes a clamp body 50 having an attachment portion 52 adapted for coupling engagement with surgical support apparatus such as the support leg 26 and, a fixed jaw member 54 for engaging the upper portion of the side rail 18. A cavity 56 is formed within the clamp body 50 of appropriate dimensions to receive a compression member 58. As can best be seen in FIG. 7, the chamber 56 is in the form of a rectangular slot which is centered within the clamp body portion 50.

The compression member 58 is provided with a cam portion 60 and a jaw portion 62. The compression member 58 is mounted for free rotation on a pin 64 which is received within a bore 66 which extends transversely through the body portion 50 as can best be seen in FIG. 6.

According to the foregoing arrangement, the jaw portion 62 of the compression member 58 is rotatable from a substantially open, retracted position as illustrated in FIG. 3, to a partially closed position as illustrated in FIG. 4. The compression member 58 is freely movable within the chamber 56 and can be manually retracted into the chamber to enlarge the distance between the jaw 54 and the jaw 62 to allow the fixed jaw 54 and the movable jaw 62 to be fitted about the upper and lower edges of the side rail 18.

The compression member 58 is driven into engagement with the inside lower corner of the side rail 18 by a turn screw 68. Attached to the external portion of the turn screw 68 is a knurled knob 70, with the opposite end of the turn screw 68 being provided with an enlarged threaded portion 72. The turn screw 68 is received within a smooth bore 74 which intersects the body portion 50 and communicates with the cavity 56 as illustrated in FIGS. 5 and 7. The bore 74 is enlarged by a threaded bore 76 which is engaged by the threaded portion 72 of the turn screw. In FIG. 3, the turn screw 68 is near the limit of its retraction within the threaded bore 76, thereby allowing the compression member 58 to be retracted within the cavity 56. In this configuration, the clamp assembly 32 can be quickly and easily mounted onto or removed from the side rail 18.

Referring now to FIG. 4, as the turn screw 68 is advanced through the threaded bore 76, the end portion 78 of the turn screw engages the cam portion 60 of the compression member 58 thereby causing the compression member 58 to rotate from its retracted position to an extended position in which its jaw portion 62 is forced into compressive engagement with the inside lower corner of the side rail 18. In this configuration, the side rail 18 is captured by the compressive force of engagement, thereby rigidly anchoring the clamp 32 at the desired location. The compressive force is transmitted by the turn screw 68 through the compression member 58, with the compression force being maintained by the reaction forces imparted by the threads of the threaded bore 76 and by the reaction forces which arise in response to engagement of the fixed jaw 54 with the upper portion of the side rail 18.

When removal of the clamp 32 is desired, the turn screw 68 is withdrawn from the cavity through the threaded bore of 76, thereby allowing the compression member to be rotated to its retracted, open jaw position as shown in FIG. 3.

The compression member 58 is shown in greater detail in FIG. 9. A cylindrical bore 80 is formed through the body of compression member 58 for receiving the pin 64.

Referring to FIGS. 3 and 8, the coupling portion 52 of the clamp body 50 is provided with a threaded bore 82 for receiving a corresponding threaded portion of support leg 26. The auxiliary support apparatus can, if desired, be welded within the bore 82.

The jaw configuration illustrated in the embodiment shown in FIGS. 3–8 is particularly well suited for anchoring engagement with a side rail having a rectangular configuration. The jaw 54 is articulated by a first flange portion 54A which projects at a right angle from the clamp body portion 50, and a second flange portion 54B which projects transversely to the first flange portion. The inside face of flange portion 54B is an inclined planar surface 55. The surface 55 is inclined away from the clamp body portion and generally defines an obtuse angle with respect to planar surface 85. According to this arrangement, the fixed jaw 54 will engage and lock side rails of various thicknesses. The inside face 84 of clamp body 50 is a planar surface which joins at a right angle with the inside face 85 of fixed jaw 54. The depth of jaw 54 is preferably large enough to accomodate the thickness of rail 18 as suggested by drawing FIGS. 3 and 4. According to the foregoing arrangement, the exterior face of side rail 18 is disposed in positive surface-to-surface engagement with the planar face 84 of clamp 32, while the upper edge portions of the side rail 18 are captured by the fixed jaw 54.

As can best be seen in FIG. 4, the force of compression is transmitted along line contact between the lower inside corner of side rail 18 and the inside face 86 of the movable jaw portion 62. The result of this engagement is compression forces are being applied along the width of side rail 18, at the same time that compression forces are developed along its length. This compressive engagement along mutually orthogonal axes provides a superior clamping union between the clamp 32 and the side rail 18. According to this arrangement, the clamp assembly 32 is stabilized against rotation about side rail 18, and is also stabilized against sliding movement along side rail 18.

Accordingly, it will be seen that the improved clamping assembly 32 can be quickly and easily anchored onto the side rail of an operating table, and can be quickly released and removed from the side rail without disturbing the established positions of other surgical support devices anchored to the same side rail.

The foregoing disclosure and description of the invention are illustrated in explanatory thereof, and various changes in the size, shape and materials, as well as in the details of the illustrated construction may be made without departing from the spirit of the invention.

I claim:

1. A clamp for attaching support apparatus onto a side rail of the type having exterior side surfaces formed along common edges comprising, in combination:

a clamp body having an attachment portion adapted for coupling engagement with support apparatus, a fixed jaw member projecting from said clamp body for engaging said side rail, and having a cavity for receiving a compression member;

said fixed jaw member having a first flange portion projecting transversely with respect to said clamp body, and having a second flange portion attached to said first flange portion and projecting transversely thereto;

said clamp body having a planar surface for engaging a major exterior side surface of said side rail, and said first flange portion having an inside planar surface joining said clamp body planar surface substantially at a right angle, and said second flange portion having an inside planar surface inclined with respect to the planar surface of said clamp body for engaging an edge portion of said rail;

a compression member being mounted within said clamp body cavity for movement away from said fixed jaw member to an open, retracted position allowing positioning of said fixed jaw member and said compression member about opposite exterior side surfaces of said rail, and for movement from the retracted position to an extended position allowing confinement and engagement of said rail on opposite exterior side surfaces thereof by said fixed jaw portion and said compression member;

said compression member being mounted on said clamp body for pivotal movement to and from its extended and retracted positions, said compression member comprising a cam for engaging said drive means and a jaw carried by said cam having an inside planar surface for engaging an edge portion of said side rail; and, means coupled to said clamp body for driving said compression member from its open, retracted position to its extended position.

2. A clamp as defined in claim 1, said clamp body having a threaded bore communicating with said locking cavity, and said driving means comprising a threaded shaft received in threaded engagement with said threaded bore, said shaft advancing into and withdrawing from said locking cavity in response to rotation and counter-rotation, respectively, of said shaft.

* * * * *